US005528471A

United States Patent [19]

Green

[11] Patent Number: 5,528,471

[45] Date of Patent: Jun. 18, 1996

[54] SKYLIGHT AND LAMP COMBINATION

[76] Inventor: Parish O. Green, 4032 O. St. Apt. 44, Bakersfield, Calif. 93301

[21] Appl. No.: 269,106

[22] Filed: Jun. 30, 1994

[51] Int. Cl.[6] ..... F21S 3/02

[52] U.S. Cl. ..... 362/147; 362/260; 362/364; 362/404

[58] Field of Search ..... 362/1, 20, 147, 362/148, 228, 260, 364, 404; 52/28; 160/98

[56] References Cited

U.S. PATENT DOCUMENTS

| | | | |
|---|---|---|---|
| 3,113,728 | 12/1963 | Boyd | 362/147 X |
| 3,205,351 | 9/1965 | Walker | 52/28 X |
| 4,114,186 | 9/1978 | Dominguez | 362/150 X |
| 4,762,160 | 8/1988 | Bechtold et al. | 160/98 |
| 5,130,915 | 7/1992 | Lerch | 362/148 X |

*Primary Examiner*—Stephen F. Husar

[57] ABSTRACT

A skylight and lamp combination for illuminating a room with natural and artificial light comprising a hollow housing having an open top end sealed with a generally transparent upper cover, an open bottom end, and a peripheral surface therearound with the housing adapted to be secured to a roof such that the top end is extended upwards therefrom for collecting incident natural light and the bottom end is extended downwards into a room for releasing the natural light; and a plurality of lamp fixtures disposed within the housing and coupled thereto for emitting artificial light through the bottom end of the housing when electrically energized.

4 Claims, 4 Drawing Sheets

SKYLIGHT AND LAMP COMBINATION

BACKGROUND OF THE INVENTION

1. Field of the Invention

The present invention relates to a skylight and lamp combination and more particularly pertains to illuminating a room with natural and artificial light with a skylight and lamp combination.

2. Description of the Prior Art

The use of lamps is known in the prior art. More specifically, lamps heretofore devised and utilized for the purpose of illuminating rooms are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,281,365 to Elving et al. discloses a variable photoelectric cell. U.S. Pat. No. 4,809,468 to Baresiss discloses a light transmitter interconnecting a skylight and a ceiling opening. U.S. Pat. No. 4,833,838 to Van Dame discloses an energy-efficient skylight structure. U.S. Pat. No. 5,130,915 to Lerch discloses a dome shaped lighting fixture. U.S. Pat. No. 5,139,900 to Yano et al. discloses an illuminating device.

While these devices fulfill their respective, particular objective and requirements, the aforementioned patents do not describe a skylight and lamp combination that is adapted to illuminate a room using natural light, artificial light, or both.

In this respect, the skylight and lamp combination according to the present invention substantially departs from the conventional concepts and designs of the prior art, and in doing so provides an apparatus primarily developed for the purpose of illuminating a room with natural and artificial light.

Therefore, it can be appreciated that there exists a continuing need for new and improved skylight and lamp combination which can be used for illuminating a room with natural and artificial light. In this regard, the present invention substantially fulfills this need.

SUMMARY OF THE INVENTION

In the view of the foregoing disadvantages inherent in the known types of lamps now present in the prior art, the present invention provides an improved skylight and lamp combination. As such, the general purpose of the present invention, which will be described subsequently in greater detail, is to provide a new and improved skylight and lamp combination and method which has all the advantages of the prior art and none of the disadvantages.

To attain this, the present invention essentially comprises, in combination, a rigid, hollow, generally frustum-shaped housing having an open top end sealed with an transparent and convex upper cover, an open bottom end sealed with a transparent and planar lower cover, and a peripheral surface therearound having four sides with a generally rectangular cross-section with the housing adapted to be secured to a roof such that the top end extends upwards therefrom for collecting incident natural light and the bottom end extends downwards into a room for releasing the natural light. A pair of fluorescent lamp fixtures is included with each lamp fixture disposed within the housing and coupled to opposite sides thereof at a location near the bottom end and with each lamp fixture emitting artificial light when electrically energized. A pair of concave reflectors is included with each reflector disposed within the housing and coupled to a side thereof directly above a separate lamp fixture for directing artificial light generated from the lamp fixture downwards into a room through the lower cover. A retractable shade is included and has a horizontal and rigid cylinder pivotally coupled to a side of the housing directly above a reflector and a generally rectangular and rolled sheet of non-transparent material disposed therearound having an inward base edge coupled to the cylinder and an opposite and outward free edge extendable therefrom. A pulley is coupled to a side of the housing opposite the shade and directly above a reflector. Lastly, a draw string is included and has one end coupled to the free edge of the shade and the other end extended over the pulley and projected downwards through the bottom of the housing to a position below the transparent cover and terminated at a handle. When the handle is pulled, the shade is extended the across the housing, thus preventing natural light from being directed downwards into a room.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved skylight and lamp combination which has all the advantages of the prior art lamps and none of the disadvantages.

It is another object of the present invention to provide a new and improved skylight and lamp combination which may be easily and efficiently manufactured and marketed.

It is a further object of the present invention to provide a new and improved skylight and lamp combination which is of durable and reliable construction.

An even further object of the present invention is to provide a new and improved skylight and lamp combination which is susceptible of a low cost of manufacture with regard to both materials and labor, and which accordingly is then susceptible of low prices of sale to the consuming public, thereby making such a skylight and lamp combination economically available to the buying public.

Still yet another object of the present invention is to provide a new and improved skylight and lamp combination which provides in the apparatuses and methods of the prior art some of the advantages thereof, while simultaneously overcoming some of the disadvantages normally associated therewith.

Even still another object of the present invention is to provide a new and improved skylight and lamp combination for illuminating a room with natural and artificial light.

Lastly, it is an object of the present invention to provide a new and improved skylight and lamp combination comprising a hollow housing having an open top end sealed with a generally transparent upper cover, an open bottom end, and a peripheral surface therearound with the housing adapted to be secured to a roof such that the top end is extended upwards therefrom for collecting incident natural light and the bottom end is extended downwards into a room for releasing the natural light; and a plurality of lamp fixtures disposed within the housing and coupled thereto for emitting artificial light through the bottom end of the housing when electrically energized.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
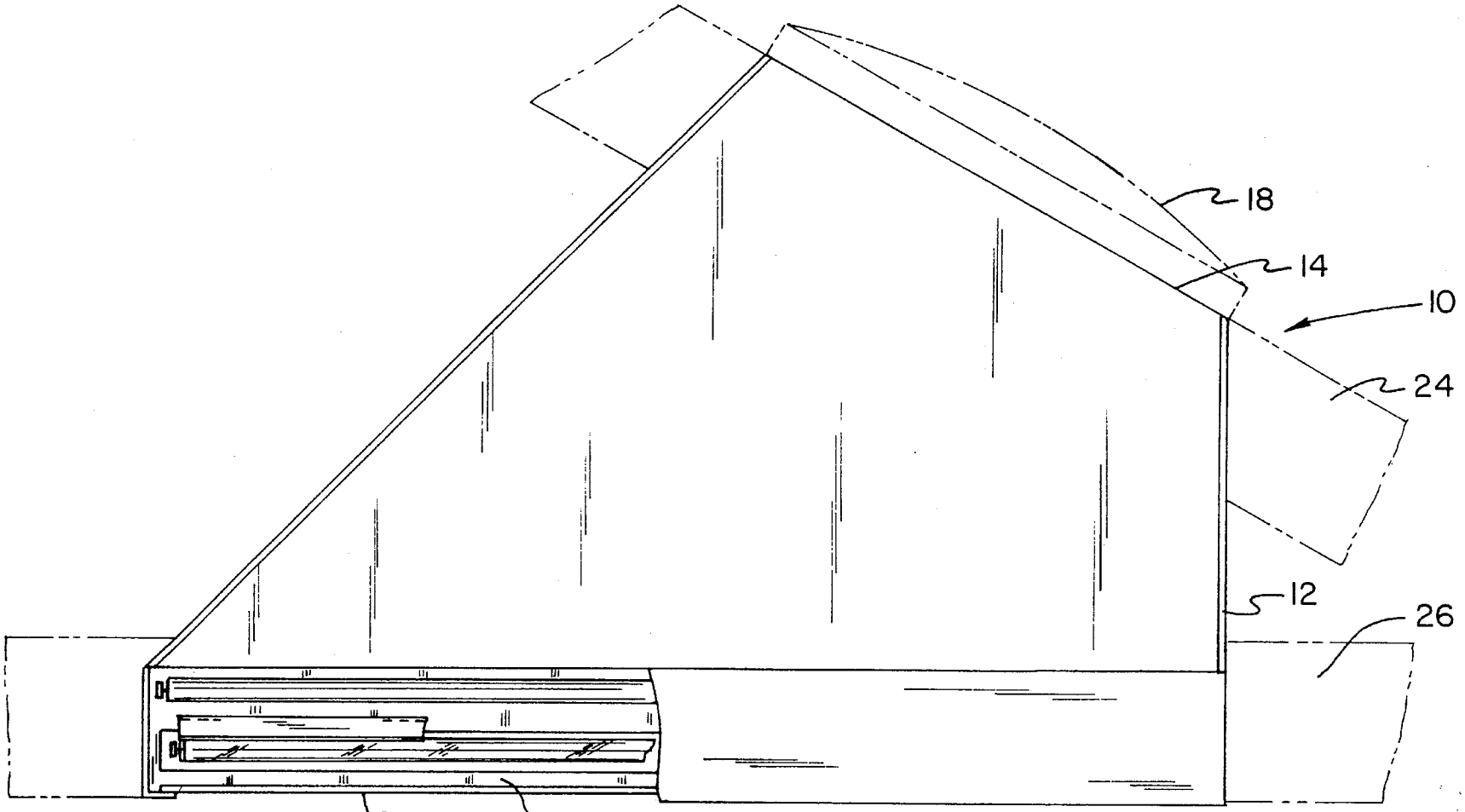
FIG. 1 is a cross-sectional view of the preferred embodiment constructed in accordance with the principles of the present invention with its top end extended through a roof and its bottom end extended within a room for providing natural and artificial lighting.
Figure 2:
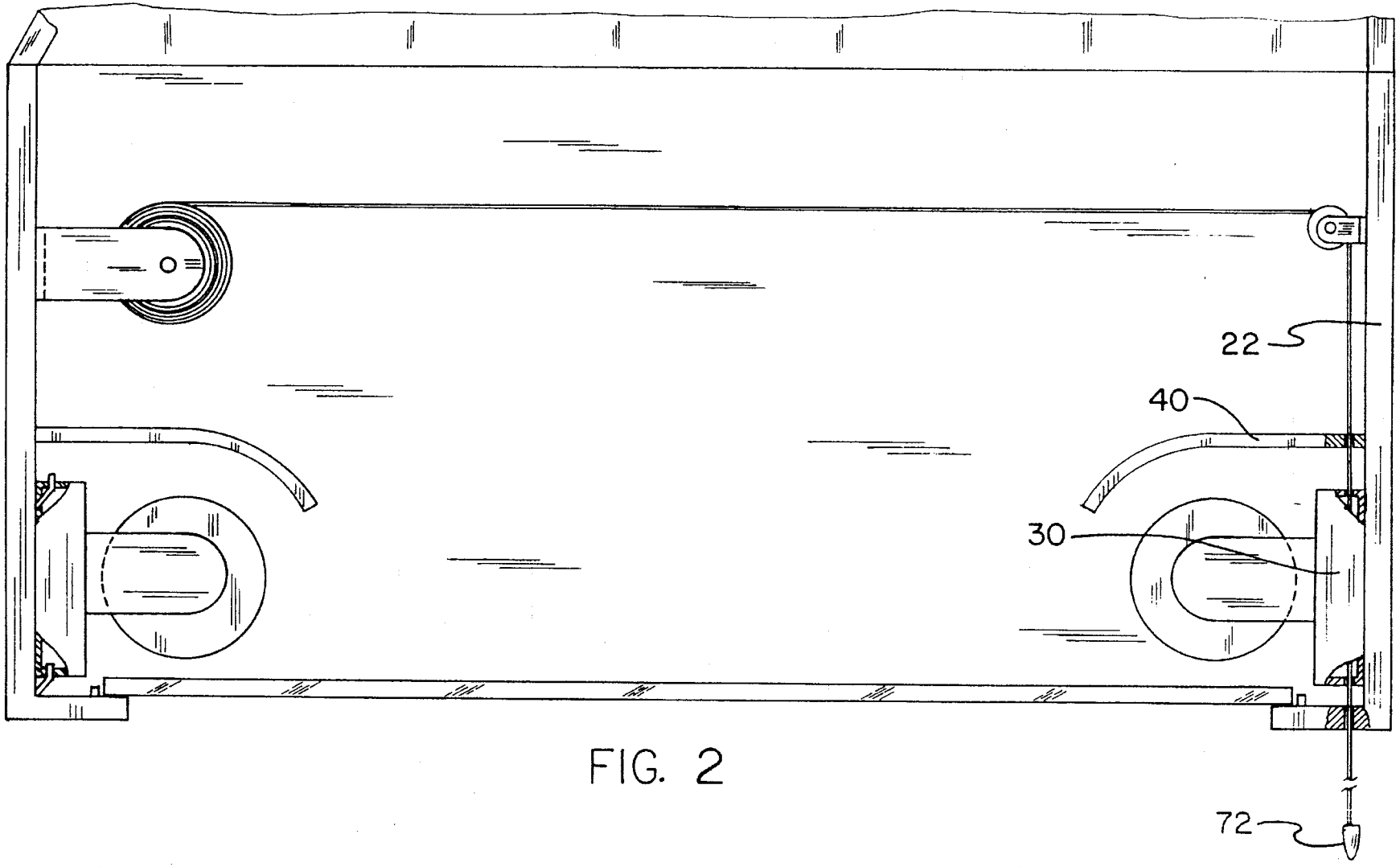
FIG. 2 is a cross-sectional and enlarged view of the lamp fixtures, reflectors, and retractable shade of the present invention.
Figure 3:
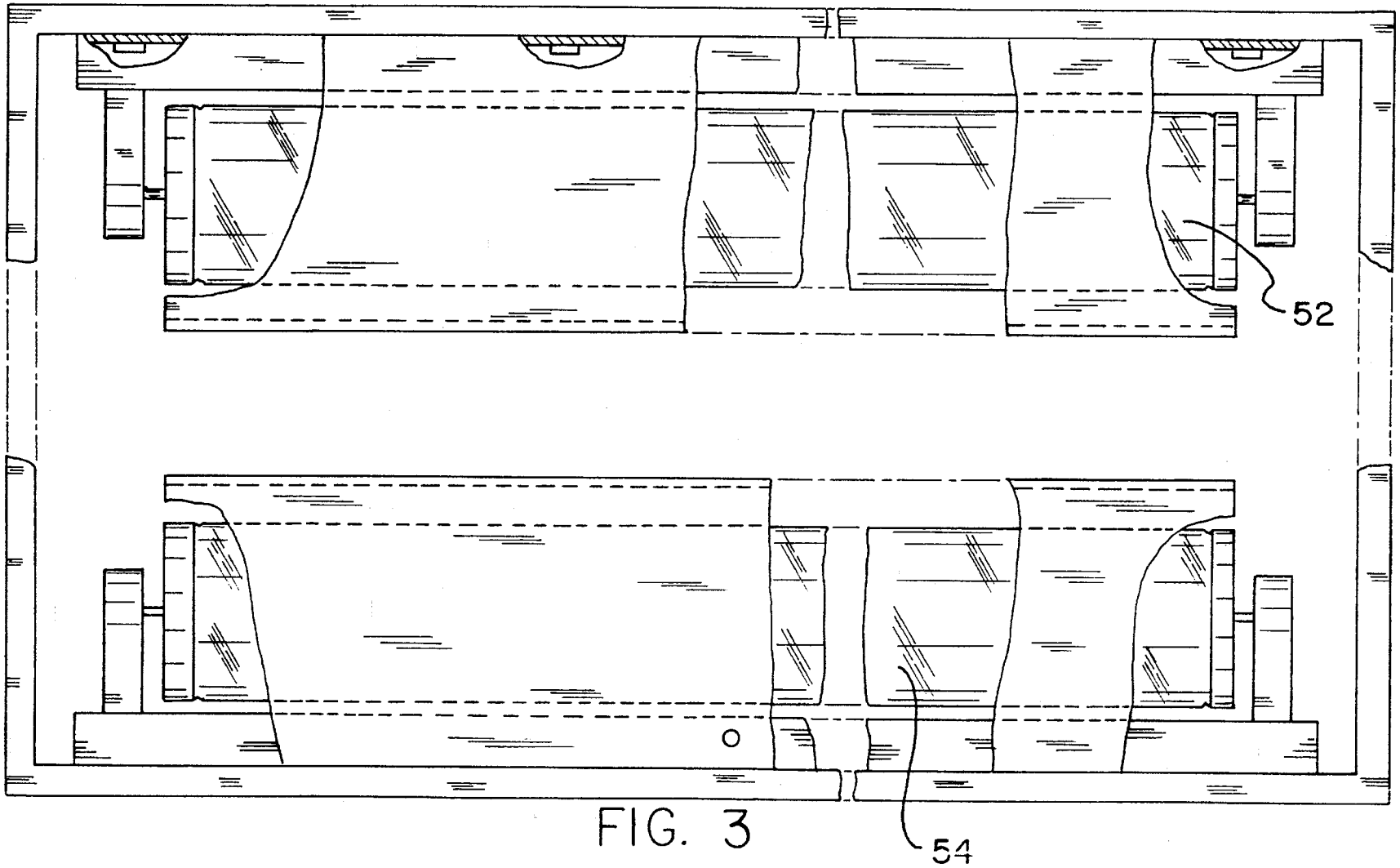
FIG. 3 is a cross-sectional and plan view of the present invention with portions of the reflectors removed for depicting the lamp fixtures.
Figure 4:
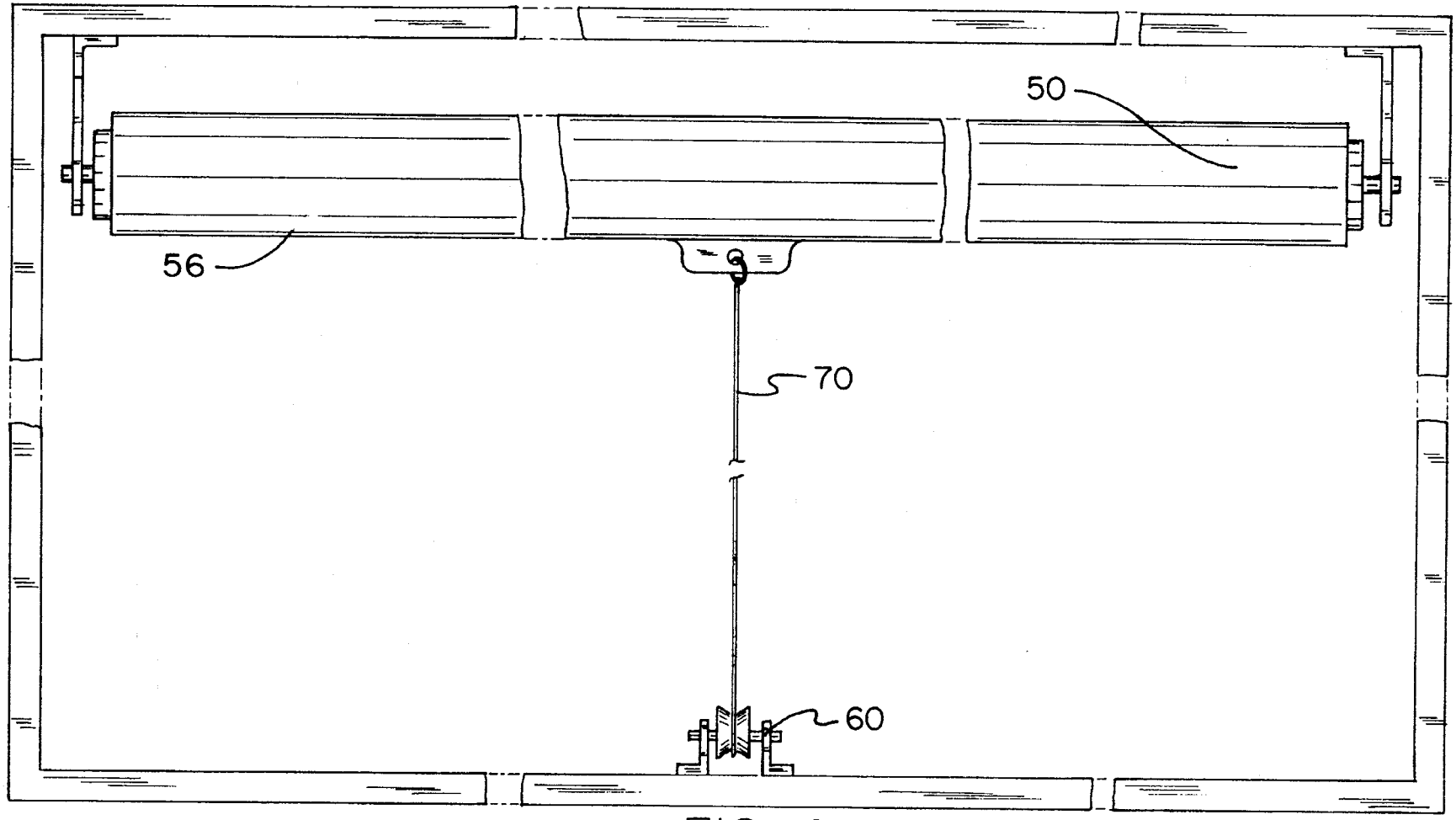
FIG. 4 is a cross-sectional and plan view of the present invention depicting the coupling between the retractable shade, pulley, and drawstring.

With reference now to the drawings, and in particular, to FIG. 1 thereof, the preferred embodiment of the new and improved skylight and lamp combination embodying the principles and concepts of the present invention and generally designated by the reference number 10 will be described.

Specifically, the present invention includes six major components. The major components are the housing, lamp fixtures, concave reflectors, shade, pulley, and drawstring. These components are interrelated to provide the intended function.

More specifically, it will be noted in the various Figures that the first major component is the housing 12. The housing is rigid, hollow, and generally frustum-shaped in structure. The housing has an open top end 14 and an open bottom end 16. A transparent and convex upper cover 18 is coupled across the open top end 14. A transparent and planar lower cover 20 is coupled across the open bottom end 16. Generally opaque and colored covers may be utilized also. The housing includes a peripheral surface 22 therearound. The peripheral surface has four sides with a generally rectangular cross-section. The peripheral surface in combination with the open top end and open bottom end define a channel for directing light therethrough. The housing is adapted to be secured to a roof 24 such that the top end extends upwards from the roof for collecting incident light and the bottom end extends downwards into a room 26 for releasing the natural light form the channel defined by the housing. A secondary function of the housing is to hold the major components of the present invention contained in one unit, thereby allowing easy installation.

The second major component is the lamp fixtures 30. The present invention includes a pair of fluorescent lamp fixtures. Each lamp fixture has a base with an elongated and replaceable fluorescent bulb coupled thereto. Each lamp fixture is disposed within the housing. Each base of each lamp fixture is coupled to opposite sides of the housing at a location near the bottom end 16. The bulb of lamp fixture emits artificial light when electrically energized. Each base has a integral terminal coupled thereto adapted to be secured to an external power source in order for the lamp fixture to be energized. The lamp fixtures are conventional in design and commercially available. Incandescent light fixtures may also be used in lieu of the fluorescent light fixtures.

The third major component is the concave reflectors 40. The present invention includes a pair of concave reflectors. Each reflector is disposed within the housing and coupled to a side of the container directly above a separate lamp fixture 30. Each concave reflector is adapted for directing artificial light generated from the lamp fixture downwards into a room through the lower cover 20. The concave reflectors thus prevent artificial light from exiting the top end of the housing.

The fourth major component is the shade 50. The shade is retractable in structure. It has a horizontal and rigid cylinder 52 pivotally coupled to the side of the housing directly above one of the reflectors. The shade also has a generally rectangular and rolled sheet of non-transparent material 54 disposed therearound. The sheet has an inward base edge coupled to the cylinder and an opposite and outward free edge 56 extendable therefrom. The sheet may be made of cloth, plastic, or other similar material. In any event, the material chosen must be able to block incident natural light from traveling through the channel and exiting through the bottom end of the container.

The fifth major component is the pulley 60. The pulley is coupled to a side of the housing at a location opposite to where the shade 50 is coupled. The pulley is positioned directly above one of the reflectors 40. The pulley is placed such that it is aligned with the midpoint of the free edge extended from the shade.

The sixth major component is the drawstring 70. The drawstring has one end coupled to the free edge 56 of the shade. The other end of the drawstring is extended over the pulley 60 and coupled downwards through the bottom of the housing to a position below the lower cover. This end is then terminated with a handle 72. When the handle is pulled, the shade is extended across the housing for sealing the channel, thus preventing natural light from being directed downwards into a room.

In summary, the present invention is a fluorescent lamp for interior lighting that also utilizes light from a skylight. It consists of two metal fixture boxes for the fluorescent lights fixtures installed longitudinally in the skylight, reflectors over the fluorescent bulbs, a transparent panel covering the bottom of the assembly, and a roll-type blind located above the light fixtures. The present invention is installed like a conventional skylight. The interior side walls of the present invention are angled slightly so as to capture a greater degree of light. The interior side walls of the present invention are painted with highly reflective paint to take advantage of as much natural light as possible entering the top end of the housing. On a clear day, the blind is rolled back to expose the ambient light, which provides bright uplifting sunshine to illuminate and defuse through the interior of a dwelling. This light is supplied at no expense to the homeowner. On a cloudy day the lights are used to augment the available daylight. At night the blind is rolled over the unit and the fluorescent lights are used alone. Since the unit is installed inside the skylight, it also gives the effect of recessed lighting. Thus, the present invention saves natural resources by not using electricity when the available sunlight can be used instead. The present invention should appeal to anyone who wants to add dramatic lighting to their decor yet save on electric bills as well.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A skylight and lamp combination for illuminating a room with natural and artificial light comprising, in combination:

a rigid, hollow, generally frustum-shaped housing having an open top end sealed with an transparent and convex upper cover, an open bottom end sealed with a transparent and planar lower cover, and a peripheral surface therearound having four sides with a generally rectangular cross-section, the housing adapted to be secured to a roof such that the top end extends upwards therefrom for collecting incident natural light and the bottom end extends downwards into a room for releasing the natural light;

a pair of fluorescent lamp fixtures, each lamp fixture disposed within the housing and coupled to opposite sides thereof at a location near the bottom end, each lamp fixture emitting artificial light when electrically energized;

a pair of concave reflectors, each reflector disposed within the housing and coupled to a side thereof directly above a separate lamp fixture for directing artificial light generated from the lamp fixture downwards into a room through the lower cover;

a retractable shade having a horizontal and rigid cylinder pivotally coupled to a side of the housing directly above a reflector and a generally rectangular and rolled sheet of non-transparent material disposed therearound having an inward base edge coupled to the cylinder and an opposite and outward free edge extendable therefrom;

a pulley coupled to a side of the housing opposite the shade and directly above a reflector; and a draw string having one end coupled to the free edge of the shade and the other end extended over the pulley and projected downwards through the bottom of the housing to a position below the transparent cover and terminated at a handle, whereby when the handle is pulled, the shade is extended the across the housing, thus preventing natural light from being directed downwards into a room.

2. A skylight and lamp combination for illuminating a room with natural and artificial light comprising:

a hollow housing generally frustum-shaped in structure having an open top end sealed with a generally transparent upper cover, an open bottom end, and a peripheral surface therearound comprising slightly angled walls, the housing adapted to be secured to a roof such that the top end is extended upwards therefrom for collecting incident natural light and the bottom end is extended downwards into a room for releasing the natural light;

a plurality of lamp fixtures disposed within the housing and coupled thereto for emitting artificial light through the bottom end of the housing when electrically energized;

a retractable shade having a rigid cylinder pivotally coupled to the housing above the lamp fixtures and rolled sheet of material disposed therearound having an inward base edge coupled to the cylinder and an opposite and outward free edge extendable from the cylinder;

a pulley coupled to the housing opposite the shade; and a drawstring having one end coupled to the free edge of the shade and the other end extended over the pulley and projected downwards through the bottom of the housing and terminated at a handle, whereby when the handle is pulled, the shade is extended across the housing, thus preventing natural light being directed downwards into a room.

3. The skylight and lamp combination as set forth in claim 2 further comprising a plurality of concave reflectors, each reflector disposed within the housing and coupled thereto directly above a separate lamp fixture for directing light generated from the lamp fixture downwards into a room.

4. The skylight and lamp combination as set forth in claim 2 further including a generally transparent lower cover secured to the bottom end of the housing.

* * * * *